United States Patent [19]

Brown, Jr.

[11] 4,252,156

[45] Feb. 24, 1981

[54] TAPE CONTROL DEVICE FOR SHUTTLELESS LOOMS

[75] Inventor: Ralph H. Brown, Jr., Hopedale, Mass.

[73] Assignee: Rockwell International Corporation, Pittsburgh, Pa.

[21] Appl. No.: 1,659

[22] Filed: Jan. 8, 1979

[51] Int. Cl.[2] ..... D03D 47/12

[52] U.S. Cl. ..... 139/449

[58] Field of Search ..... 139/446, 449; 74/230.3, 74/230.8, 230.13

[56] References Cited

U.S. PATENT DOCUMENTS

| | | | |
|---|---|---|---|
| 2,191,376 | 2/1940 | Gabler | 139/449 |
| 3,987,822 | 10/1976 | Freisler | 139/449 |

FOREIGN PATENT DOCUMENTS

| | | | |
|---|---|---|---|
| 2270356 | 12/1975 | France | 139/449 |

*Primary Examiner*—Henry Jaudon

[57] ABSTRACT

A control device for actuating the weft carriers attached to opposed flexible tapes in a shuttleless loom. One end of each tape is attached to a driving arm with the opposite ends of the latter being fixed on oscillatably driven hub members. One side of each hub member has a disc element mounted thereon for movement therewith. The periphery of the disc members are disposed in operative association with the ends of the driving arms to which the tapes are attached and define platforms onto which the tapes are wrapped and unwrapped during their withdrawal from and insertion into a shed of warp threads by the driving arm.

7 Claims, 4 Drawing Figures

TAPE CONTROL DEVICE FOR SHUTTLELESS LOOMS

BACKGROUND OF THE INVENTION

Shuttleless looms of the type to which the instant invention is applicable have opposed carrier elements which are attached to the free ends of flexible tapes. Prior to the present invention the opposite ends of these tapes have been fixedly attached to a point on the outer peripheral surface of oscillatably driven tape wheels disposed at the sides of a loom.

A number of U.S. patents describe and clearly illustrate the looms and mechanism for actuating flexible tapes and carriers by means of oscillating tape wheels and it is considered unnecessary at this point to insert herein a detailed description of these mechanisms. Attention is hereby drawn to U.S. Pat. Nos. 2,604,123 and 2,810,403.

The well known and conventional form of tape wheel is that fabricated from an aluminum casting which includes a rim section that is connected to the hub thereof by means of a plurality of equally spaced spoke elements. Although such tape wheels have satisfactorily performed their intended function the high inertia which they possess has been a limiting factor in achieving higher loom speeds without introducing excessively high loads on the driving mechanisms which actuate said tape wheels.

For looms of the type to which the present invention is applicable, U.S. Pat. No. 3,987,822 discloses a form of tape or so-called band wheel for effecting insertion and withdrawal of flexible tapes, with their respective carriers, from sheds of warp threads. The teachings of this patent pertain to an oscillatable driving wheel that is fabricated from a light weight material and which produces a small moment of inertia.

The present invention provides a tape control device which, by comparison with the conventional means for actuating the tapes, produces considerably less load on the tape driving mechanism and permits a loom to be satisfactorily operated at substantially greater speeds than has been heretofore possible.

SUMMARY OF THE INVENTION

The tape control device of the present invention eliminates the conventional tape wheel and provides a hub member that is mounted on the drive mechanism for oscillating such wheels. A driving arm fabricated from lightweight material has one end attached to the hub member and extending radially outward from the axis of the hub, its outer end has one end of a flexible tape fixed thereon.

A disc element also formed of lightweight material is assembled on the forward surface of the hub member for movement therewith and with a portion of the peripheral surface of said disc element being disposed in close proximity with that end of the driving arm to which the flexible tape is attached.

The driving arm being attached to the hub member is oscillated therewith and is effective in causing the tape with its carrier to be inserted and withdrawn from the sheds of warp threads.

The disc element being mounted for oscillating movement with the driving arm, and with a portion of its peripheral surface being disposed in close proximity with the outer end of said arm, a supporting surface is provided about which the flexible tape is wrapped and unwrapped during its withdrawal and insertion into the warp sheds by said driving arm.

It is a general object of the invention to provide a tape control device for shuttleless looms which will permit such looms to operate at greater speeds than has been heretofore possible. A further object of the invention is to provide a tape control device of lightweight construction which imparts a minimum amount of load on the driving mechanism for effecting insertion and withdrawal of flexible tapes from sheds of warp threads.

It is a further object to provide a tape control device having a tape supporting element of simplified construction, inexpensive to manufacture and which can be quickly and easily assembled on or removed from a loom with a minimum amount of downtime of said loom.

These and other objects of the present invention will become more fully apparent by reference to the appended claims and as the following detailed description proceeds in reference to the figures of drawing wherein:

DESCRIPTION OF THE PREFERRED EMBODIMENT

Figure 1:
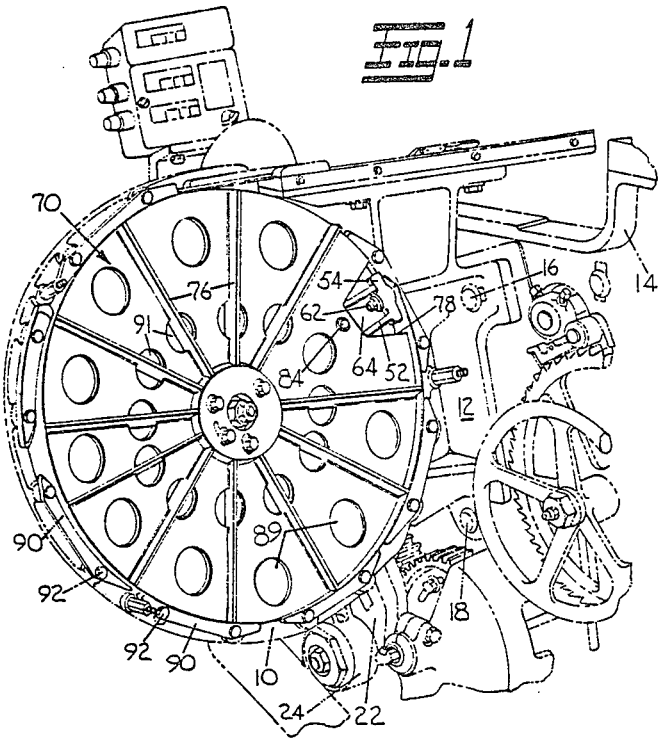
FIG. 1 is a perspective view of a portion of a shuttleless loom showing the device according to the invention applied thereto.

Referring to FIG. 1 of the drawings wherein only as much of a shuttleless loom structure is depicted as is necessary for a complete understanding of the invention, there is shown a conventional circular housing 10 having on its inner side an integrally formed supporting bracket 12 which is attached to the loomside 14 by means of bolts 16 and 18.

A driven shaft 20 extends forwardly through a central opening in the housing 10 and is oscillatably driven by a well known drive mechanism partially shown in FIG. 1 by a crank 22 and a pitman 24. That portion of the drive mechanism not shown includes a rack and spur gears to operatively interconnect the shaft 20 with the upper end of the pitman 24.

Figure 2:
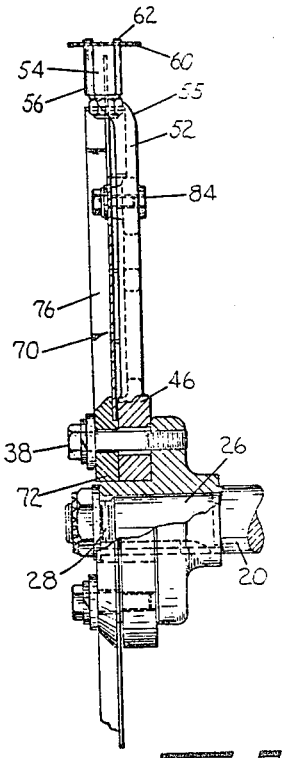
FIG. 2 is an end view and partially in section of the device shown in FIG. 1.
Figure 3:
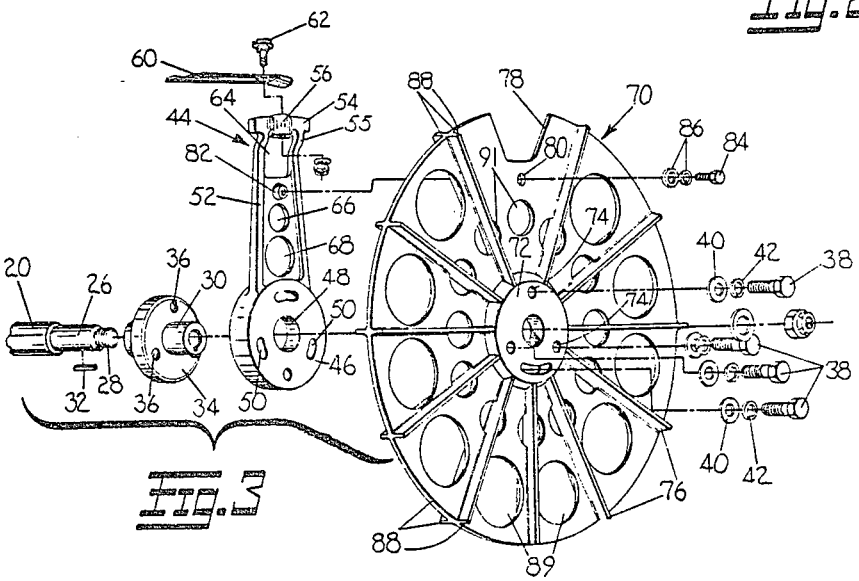
FIG. 3 is a perspective view in exploded form showing the various elements comprising the invention.

As shown in FIGS. 2 and 3, the drive shaft is of reduced diameter adjacent its forward end as shown at 26 and said forward end being of less diameter is threaded as at 28.

The various elements comprising the invention are mounted on that portion of shaft 20 identified by numeral 26 for oscillating movement therewith and includes a driving hub 30 that is fixed on said shaft by any suitable means such as a key 32 (FIG. 3). This driving hub 30 includes an integrally formed mounting flange 34 disposed intermediate its ends having appropriate threaded holes 36 for attaching the remaining elements of the invention thereto by means of a plurality of cap screws 38. As shown in FIG. 3, these cap screws 38 are each provided with a plain washer 40 and lock washer 42 for maintaining the elements now to be described in driving relationship with the driving hub 30.

A driving arm generally indicated by numeral 44, and made from any suitable lightweight material such as aluminum, is provided with a hub portion 46 having a central opening 48 for assembly on the driving hub 30. This hub portion 46 includes an array of elongated openings 50 which align with the threaded holes 36 and through which the threaded portion of the cap screws 38 are adapted to extend.

A pair of spaced rib members having an integral web disposed therebetween extends from the hub portion 46 in a plane normal to the axis of the latter and defines a tape driving arm 52. The end of this driving arm most remote from the hub portion 46 is identified by numeral 54 and forms an arcuated cross member that interconnects the rib members of said driving arm. This cross member 54 includes a centrally disposed and integrally formed boss 56 having an opening 58 extending therethrough which serves to attach a flexible tape 60 to the outer surface of said cross member by means of a bolt nut and washer combination identified by numeral 62.

Figure 4:
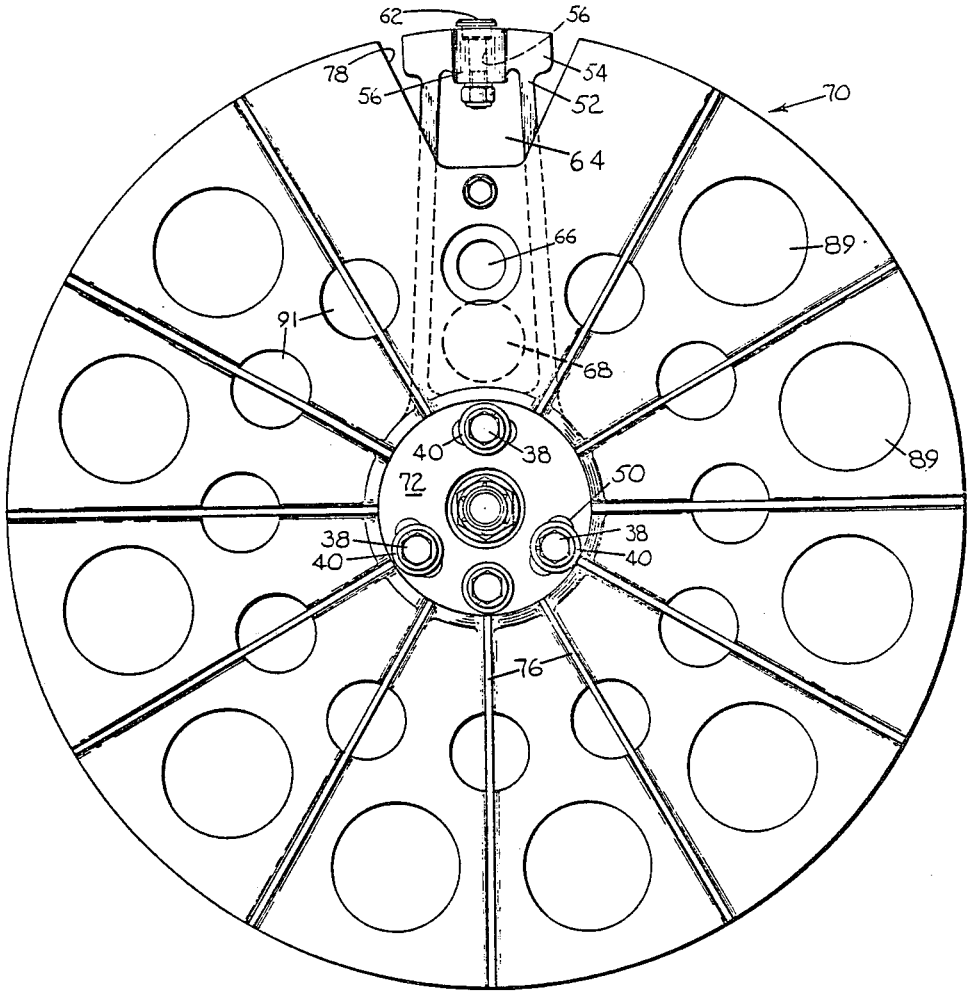
FIG. 4 is a view in side elevation and on an enlarged scale of the elements shown in FIG. 3.

To further reduce the weight of the tape driving arm 52, which is formed from a lightweight rigid material, the web portion thereof extends for only a portion of the length of the spaced rib members so as to form an opening 64 adjacent the cross member 54 and openings 66 and 68 within said web portion (FIGS. 3 and 4).

As shown in FIGS. 2 and 3, the end of the tape driving arm having the cross member 54 is slightly off-set as shown at 55 and serves a purpose yet to be described.

A circular disc generally indicated by numeral 70 having a hub 72 with through openings 74 that align with those in hub portion 46 and in the mounting flange 34 is assembled on the forward face of said hub portion 46 by means of the aforementioned cap screws 38 and their respective washers 40 and 42. This circular disc 70 is fabricated from any suitable lightweight rigid material such as plastic or aluminum and includes a plurality of equally spaced and radially extending reinforcing rib elements 76 which protrude forwardly and rearwardly from each side of said disc.

As shown in FIGS. 1, 3 and 4 a recess 78 is formed in the periphery of the disc 70 which in assembled position provides clearance for the off-set cross member 54 so that the center of the flexible tape is in alignment with the periphery of said disc. Immediately below the recess 78 the disc 70 is provided with an opening 80 (FIG. 3) that is in alignment with a threaded boss 82 on the driving arm 44 and by means of a cap screw 84 and washers 86 an additional means is provided for attaching the disc 70 to said driving arm.

The reinforcing rib elements which extend outwardly from the hub 72 terminate at the peripheral surface of the disc 70 to form lateral extensions of said surface. The combination of the disc's periphery and the lateral extensions which are caused to oscillate with the driving arm 44 provide a platform 88 onto which the flexible tape 60 can be wrapped and unwrapped during its withdrawal and insertion into sheds of warp thread by the driving arm 44. To further reduce the weight of the disc 70 which is formed from a lightweight rigid material, it is provided with a first circular array of openings 89 disposed adjacent the periphery of said disc and a second circular array of smaller openings 91 disposed intermediate said first circular array and the hub 72.

In close proximity with the outer surface of the flexible tape 60 the circular housing 10 includes a plurality of conventional arcuate shoe members 90 which are attached thereto by means of cap screws 92 and are circumferentially disposed throughout a considerable extent, at least, of the circumferential extent of the disc 70. These shoe members 90 are effective in maintaining the tape 60 in close proximity with the platform 88 of the disc 80 while it is being unwrapped therefrom and inserted into a warp shed by the driving arm 44. The reinforcing ribs 76 being disposed so as to extend forwardly and rearwardly from each side of the disc 70, also define vane elements which are effective in causing air to flow outwardly toward the tape and effectively assist in dissipating heat generated by frictional contact of the tape with the shoe members 90. It should be understood that while only a single driving arm and its cooperating elements have been shown and described, the opposed flexible tape with its carrier being located at the opposite side of the loom, utilizes the same type of elements for causing that tape to perform its intended function.

To summarize the operation the driving arm 44 and the disc 70 attached thereto are oscillated to and fro slightly less than a full revolution and the flexible tape attached to said driving arm is caused to insert and withdraw its weft carrier from the warp shed in timed relation to the weaving cycle. With the disc 80 being mounted on the hub 46 of the driving arm 44 and with its periphery being aligned with the central portion of the tape 60, a means is provided for storing the tape in a coiled position when it is withdrawn from the shed by the driving arm and serves to guide said tape during its weft insertion movement.

Comparison tests were conducted on two identical width shuttleless looms in which one of the looms was equipped with a conventional form of tape wheel mechanism and the other with the tape control device of the present invention. The results of these tests showed that with the loom equipped with the tape control device of the invention and running at 293 P.P.M. there was an eight percent less load on the driving mechanism than there was on the driving device of the other loom having the conventional tape wheel mechanism and running at a considerably less speed of 254 P.P.M.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A control device for opposed flexible tapes in a shuttleless loom in which carrier members attached to the free ends of the tapes are alternately introduced and withdrawn from sheds of warp threads to effect insertion of weft therein, said control device comprising:

(a) means for actuating a flexible tape defining an oscillatable driven hub member mounted on the loom having a driving arm fixed thereon and extending outwardly therefrom in a direction normal to the axis of said hub and with one end of a flexible tape being attached to the outer end of said arm;

(b) means operatively connected to said hub and in operative association with the flexible tape for storing the latter in a coiled position when withdrawn from a warp shed by said driving arm.

2. The control device according to claim 1 wherein said storing means defines a disc element attached to one side of said hub for oscillating movement therewith.

3. The control device according to claim 2 wherein said disc element is fabricated from a lightweight rigid material.

4. The control device according to claim 1 wherein said driving arm is fabricated from a lightweight rigid material.

5. The control device according to claim 1 wherein said disc element includes a plurality of equally spaced and radially extending reinforcing ribs.

6. The control device according to claim 5 wherein said reinforcing ribs protrude from each side of said disc element to define vane members for directing cooling air in the direction of the flexible tape.

7. The control device according to claim 6 wherein said vane members terminate at the periphery of said disc element to form lateral extensions thereof with the combination of the periphery and said extensions defining a platform onto which a tape is wrapped and from which it is extended by said driving arm.

* * * * *